US008966843B2

(12) United States Patent
Paul et al.

(10) Patent No.: US 8,966,843 B2
(45) Date of Patent: Mar. 3, 2015

(54) WALL FOR SEPARATING THE INSIDE OF A BUILDING FROM THE OUTSIDE

(75) Inventors: Rene Paul, Zurich (CH); York Ostermeyer, Zurich (CH); Yutaka Goto, Dubendorf (CH); Thomas Frank, Uster (CH); Karim Ghazi Wakili, Andelfingen (CH); Holger Wallbaum, Zurich (CH)

(73) Assignee: Swiss Building Components AG, Baar (CH)

( * ) Notice: Subject to any disclaimer, the term of this patent is extended or adjusted under 35 U.S.C. 154(b) by 158 days.

(21) Appl. No.: 14/002,842

(22) PCT Filed: Mar. 11, 2011

(86) PCT No.: PCT/CH2011/000049
§ 371 (c)(1),
(2), (4) Date: Sep. 3, 2013

(87) PCT Pub. No.: WO2011/113167
PCT Pub. Date: Sep. 22, 2011

(65) Prior Publication Data

US 2014/0013687 A1 Jan. 16, 2014

(30) Foreign Application Priority Data

Mar. 15, 2010 (CH) ..... 353/10

(51) Int. Cl.
*E04B 1/74* (2006.01)
*E04C 2/24* (2006.01)
(Continued)

(52) U.S. Cl.
CPC . *E04C 2/243* (2013.01); *E04B 1/74* (2013.01); *E04B 1/76* (2013.01); *E04B 1/762* (2013.01); *E04C 2/46* (2013.01); *E04F 17/04* (2013.01)
USPC ..... 52/302.1; 52/267; 52/404.1; 52/794.1; 52/796.1

(58) Field of Classification Search
CPC ..... E04C 2/296; E04C 2/243; E04C 2/34; E04C 2/24; E04C 2/46; E04B 1/762; E04B 2/7409; E04B 1/74; E04B 1/7608
USPC ..... 52/309.13–309.15, 309.17, 783.1, 52/794.1, 796.1, 267–269, 302.1, 302.3, 52/404.1
See application file for complete search history.

(56) References Cited

U.S. PATENT DOCUMENTS 3,295,278 A * 1/1967 Muhm ..... 52/223.6
5,305,577 A * 4/1994 Richards et al. ..... 52/783.13
(Continued)

FOREIGN PATENT DOCUMENTS

DE 197 17 173 11/1998
DE 10 2005 002571 7/2006
(Continued)

OTHER PUBLICATIONS

International Search Report dated Jul. 5, 2011, corresponding to PCT/CH2011/000049.

*Primary Examiner* — Adriana Figueroa
(74) *Attorney, Agent, or Firm* — Young & Thompson

(57) ABSTRACT

The wall serves for separating the inside of a building from the outside. According to a first aspect, the wall has a water vapor diffusion resistance of at most 20 meters, wherein the heat transfer coefficient amounts to at most 1.5 W/(m$^2$·K), and the moisture storage capacity amounts to at least 2 kg/m$^2$. According to a second aspect, the wall has a bearing layer (10) as well as an outer layer (9) and an inner layer (11), which include moisture-buffering materials.

23 Claims, 2 Drawing Sheets

(51) Int. Cl.

| | |
|---|---|
| ***E04B 1/76*** | (2006.01) |
| ***E04B 2/00*** | (2006.01) |
| ***E04F 17/04*** | (2006.01) |

(56) References Cited

U.S. PATENT DOCUMENTS

| | | | | |
|---|---|---|---|---|
| 6,415,580 | B2 * | 7/2002 | Ojala | 52/794.1 |
| 6,941,720 | B2 * | 9/2005 | DeFord et al. | 52/783.14 |
| 7,662,221 | B2 * | 2/2010 | Fay | 106/15.05 |
| 7,972,688 | B2 * | 7/2011 | Letts et al. | 428/316.6 |
| 8,007,886 | B2 * | 8/2011 | Tierney et al. | 428/40.1 |
| 2008/0295450 | A1 * | 12/2008 | Yogev | 52/783.1 |
| 2009/0044484 | A1 * | 2/2009 | Berger | 52/783.1 |
| 2010/0266833 | A1 * | 10/2010 | Day et al. | 428/304.4 |

FOREIGN PATENT DOCUMENTS

| | | | |
|---|---|---|---|
| DE | 20 2009 012318 | | 11/2009 |
| FR | 2507647 | A1 * | 12/1982 |

* cited by examiner

FIG. 1a
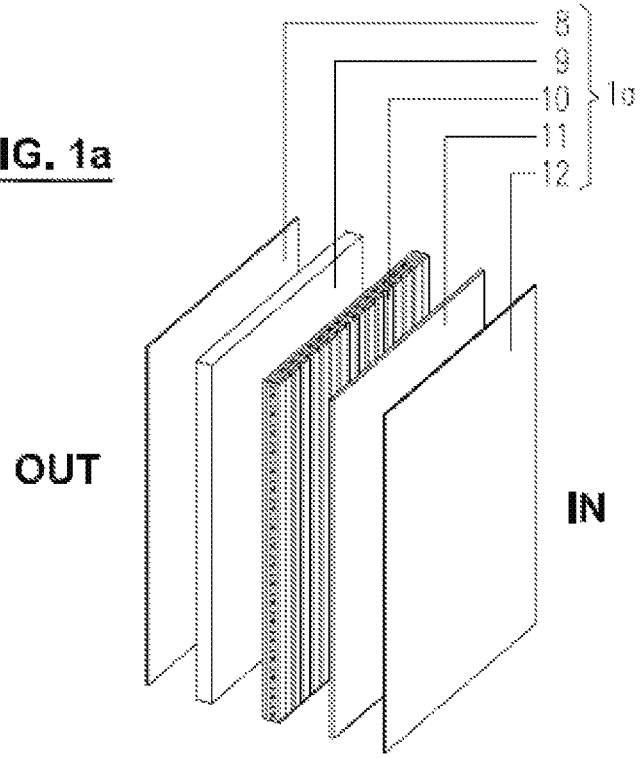
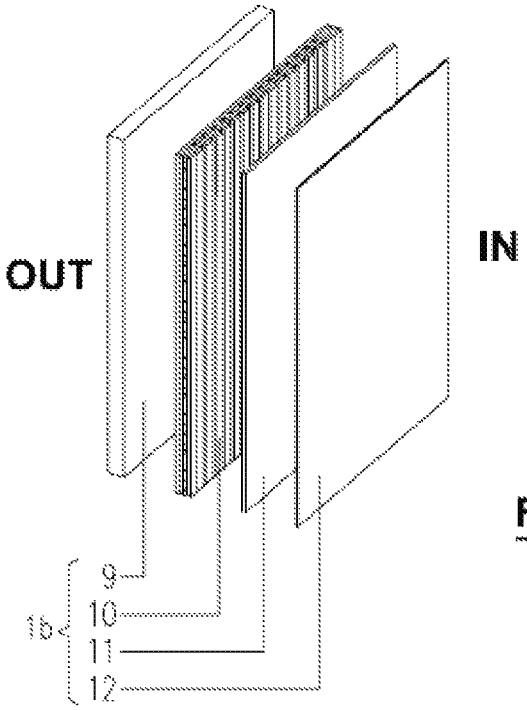
FIG. 1b

WALL FOR SEPARATING THE INSIDE OF A BUILDING FROM THE OUTSIDE

BACKGROUND OF THE INVENTION

1. Field of the Invention

The invention relates to a wall for separating the inside of a building from the outside, to a building sheath, and to a building having such a wall, as well as to a method for the construction of a building.

2. Description of the Related Art

If there is a difference in the content of water vapor or in temperature between the outside and the inside, then there is an effort to balance out this lack of equilibrium, in that a corresponding water vapor stream or heat stream occurs. In order for no damage to the building construction to occur, the wall must be designed in such a way, among other things, that no relative humidity occurs that brings about mold formation and/or the condensation of water.

In climate zones in which the water vapor stream over the course of the year always comes from the same direction, as is predominantly the case in western Europe, for example, the wall structure is configured in such a way, in order to avoid the aforementioned problems, that the moisture can leave the wall in the direction of the vapor diffusion stream more easily than it can penetrate into the wall from the direction of the vapor diffusion stream.

However, there are also climate zones in which the water vapor stream can come from both directions, i.e. from the inside and from the outside, over the course of the year. This is typically the case in those climate zones where a rainy season occurs, and thus very high humidity combined with warm temperatures prevails over an extended period of time. If it is then cooler and/or drier indoors, for example on the basis of air conditioning, then the water vapor stream is directed from the outside to the inside. During the cooler season, in contrast, the indoor spaces are generally warmer and more humid than the outdoors, so that a water vapor stream in the opposite direction occurs. Such climate conditions, with a water vapor stream in both directions, which are found in Japan, New Zealand, and other countries, for example, promote condensation and mold formation, particularly if the indoor spaces are air conditioned.

One possibility for avoiding damage to the building construction in the case of such climate conditions consists in structuring both sides of the wall to be vapor-tight, and thus to completely prevent a vapor diffusion stream through the wall. However, this configuration has the disadvantage that it is extremely susceptible to mechanical damage, and thus can easily lose its effectiveness as the result of damage to the vapor-tight planes. Often, such a configuration is therefore not used, and it is accepted that there can be problems with regard to condensation and mold formation.

BRIEF SUMMARY OF THE INVENTION

It is a task of the present invention to indicate a damage-resistant wall for separating the inside of a building from the outside, which wall is particularly suitable for climatic conditions in which a water vapor stream occurs from the inside to the outside as well as from the outside to the inside.

This task is accomplished by means of a wall in accordance with claim 1 or 15. The further claims indicate preferred embodiments of the wall according to the invention, a building sheath, and a building having such a wall, as well as a method for the construction of a building.

The wall according to the invention has the advantage, among other things, that the climate conditions that occur do not lead to mold formation or condensation of water, because of its special configuration.

Further characteristics and their advantages are evident from the following description and figures of exemplary embodiments, where

BRIEF DESCRIPTION OF THE DRAWINGS

FIGS. 1*a* and 1*b* show a first and a second exemplary embodiment of a wall according to the invention, in an exploded view.

DETAILED DESCRIPTION OF THE PREFERRED EMBODIMENTS

Figure 2:
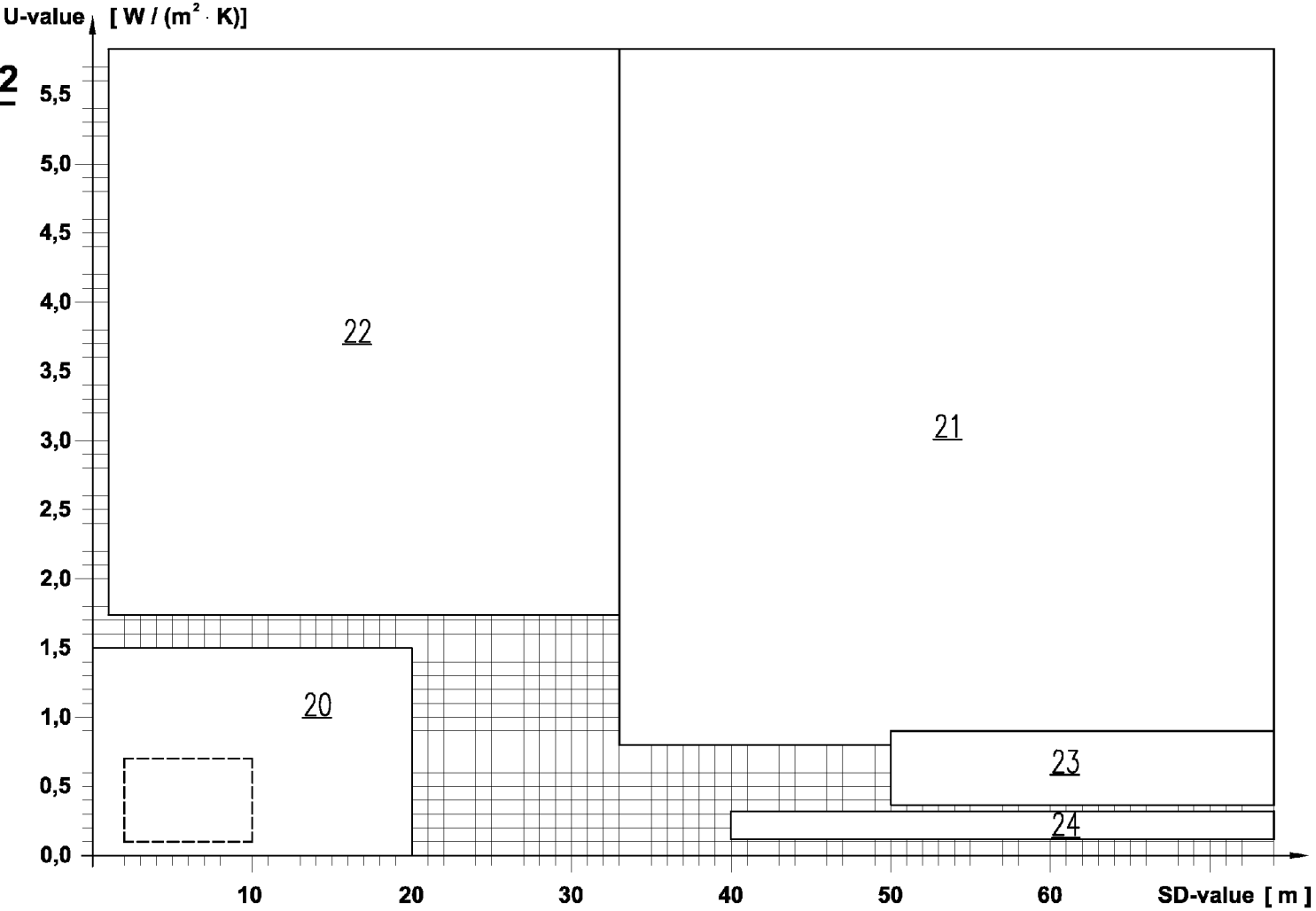
FIG. 2 shows a graphic representation in which values for the heat transfer coefficient (U-value) and the water vapor diffusion resistance (SD-value) for the wall according to the invention, as well as for various known buildings, are indicated.

Hereinafter, the following construction physics parameters and terms are referred to:

heat transfer coefficient (also called U-value):

The U-value indicates the heat stream that flows through 1 $m^2$ of a building component, perpendicular to the surface, in the stationary state, if a temperature difference of 1 Kelvin prevails between the air that lies against it on both sides. The U-value is indicated in watts per square meter and per Kelvin [$W/(m^2 \cdot K)$]. (For determining the heat transfer coefficient, see also the corresponding standard: EN ISO 6946 "Building Components and Building Elements—Thermal Resistance and Thermal Transmittance—Calculation Method".)

Water vapor diffusion resistance (also called SD-value):

The SD-value is related to the water vapor conductivity (amount of water that passes through a cross-sectional area of 1 $m^2$ per hour, if a water vapor pressure gradient of 1 Pa prevails along the diffusion distance of 1 m). The SD-value is indicated by $SD=\mu \cdot d$, where $\mu$ is the ratio of the water vapor conductivity of the air relative to the water vapor conductivity of a building component, and d is the layer thickness of the building component. The dimension of the SD-value is meters of equivalent air layer thickness [m]. (For determining the water vapor diffusion resistance, see also the corresponding standard: ISO 12572:2001 "Hygrothermal performance of building materials and products—Determination of water vapour transmission properties".)

Moisture storage capacity (also called FK-value hereinafter):

The moisture storage capacity can be stated in kilograms per square meter [$kg/m^2$] and corresponds to the amount of water vapor that can be absorbed by one square meter of a building component, in kilograms. The moisture storage capacity is determined by way of the difference in the mass that the building component demonstrates in the state of equilibrium at a specific temperature T1 and a specific relative humidity phi, and the mass that the building component has in a specific starting state. This starting state is either the dry state of the building component or the state that the building component has when it is in the state of equilibrium, at a specific starting temperature T0 and a specific starting relative humidity phi0. The dry state is achieved in that the building component is heated to 100 degrees Celsius, so that the moisture evaporates completely. (For determining the moisture storage capacity, see also the corresponding standard: ISO 12571 "Hygrothermal performance of building materials and products—Determination of hygroscopic sorption properties".) Hereinafter, the following FK-values are used:

"FK-value 0/80": Is the FK-value that results from the weight difference of the material being considered between the completely dry state and the regulated state at T1=20 degrees Celsius and phi=80%.

"FK-value 0/85": Is the FK-value that results from the weight difference of the material being considered between the completely dry state and the regulated state at T1=35 degrees Celsius and phi=85%.

"FK-value 20/80": Is the FK-value that results from the weight difference of the material being considered between the regulated starting state at T0=20 degrees Celsius and phi0=20% and the regulated state at T1=20 degrees Celsius and phi0=80%.

Thermal mass:

The thermal mass can be indicated in kilojoules per cubic meter and per Kelvin [kJ/($m^3$·K)], and corresponds to the specific heat capacity multiplied by the density.

Moisture buffering:

A moisture-buffering material has the property of being able to store liquids and/or vapor, particularly water, and later, i.e. with a time delay, to release it again in gaseous form. The processes relevant in storage particularly relate to physorption (storage by means of a physical process, e.g. accumulation of molecules on surface and/or in pores) and chemisorption (storage by means of a chemical process).

The wall (also called "outer wall" hereinafter) separates the inside of a building from the outside and serves as a bearing wall construction of the building. It comprises multiple layers, where a central, statically bearing layer is lined on both sides with additional layers.

FIGS. 1*a* and 1*b* show two exemplary embodiments of an outer wall according to the invention. The exemplary embodiment indicated as 1*a* in FIG. 1*a* has the following layers, seen in the sequence from the outside (indicated with "OUT" in FIG. 1*a*) in the direction toward the inside (indicated with "IN" in FIG. 1*a*):

an exterior finish 8,
an outer layer 9,
a bearing layer 10,
an inner layer 11, and
an interior finish 12.

Depending on the design of the outer wall, a film can be provided between the layers 9 and 10, as an additional layer, as a wind and air seal.

The exterior finish 8 is designed as a façade finish that is not water-vapor-tight, and accordingly has a regulating effect on the water vapor diffusion stream. The finish 8 is treated in such a way that mold and fungus formation is prevented. This happens, for example, in conventional manner, by means of providing suitable chemical substances. However, biocide-free finishes are also known, which regulate heat and moisture in such a manner that the formation of surface condensation is prevented, and thus no growth of algae or fungus takes place. Such finishes are commercially available under the name AQUA PURA®, for example.

The exemplary embodiment indicated in FIG. 1*b* as 1*b* is designed for a ventilated, suspended construction, and is therefore provided with a suspended façade on the finished building, in place of the exterior finish 8 (not shown in FIG. 1*b*). For the remainder, the outer wall according to exemplary embodiment 1*b* has the layers 9 to 12.

The bearing layer 10 forms the statically active element of the outer wall and is made from wood, for example. Particularly stable wooden elements are known, for example, under the name Lignotrend®. In these elements, wooden boards are glued to one another crosswise.

In the present exemplary embodiment, the bearing layer 10 is configured as a continuous plane that acts to inhibit water vapor, because of its water vapor diffusion resistance. By means of a suitable design of the further layers 9, 11 and—if present—the layers 8, 12, however, a critical moisture level in front of the water-vapor-inhibiting plane can be prevented, and in total, an outer wall having a low SD-value can be made available. Entry of moisture into the wall is therefore permitted to a certain degree. This method of functioning, by preventing possibly critical moisture amounts in front of one or more water-vapor-inhibiting planes, is also possible with embodiments other than the one shown in FIGS. 1*a* and 1*b*.

The outer layer 9 is disposed on the outside of the bearing layer 10. On the one hand, the outer layer 9 is heat-insulating, and thus serves to reduce the transmission heat losses. On the other hand, it acts as a moisture buffer, i.e. it is sorption-active, so that it is able to absorb moisture and release it again. The outer layer 9 is designed in such a manner that it absorbs moisture that penetrates from the outside to the inside, in such a manner that moisture accumulation and condensation on the bearing layer 10 is prevented.

Suitable materials as insulation for the outer layer 9, which demonstrates not only a heat-insulating function but also a moisture-regulating function, are, among others, those on an organic basis such as wood fibers, cellulose, etc. Known products are wood fiber insulations of PAVATEX® and products sold under the name ISOFLOC®.

It is also possible to use materials on a mineral basis, e.g. porous stones, as insulation.

The outer layer 9 can also be structured from multiple planes having different compositions, for example in the form of a wood fiber panel known under the name DIFFUTHERM®. It is also possible that the outer layer 9 has a graduated structure, in that one or more water-vapor-inhibiting planes (e.g. films, coatings, adhesive planes, etc.) are used in order to optimize the absorption in the insulation. Constructions structured in such a graduated manner are available as wood fiber panels under the name PAVADENTRO®, for example.

The inner layer 11 is disposed on the inside of the bearing layer 10 and forms the inner covering. The inner layer 11, like the outer layer 9, acts as a moisture buffer and is therefore active for absorption. The inner layer 11 is designed in such a that it can store the amount of moisture that occurs in the interior if the building sheath is designed to be wind-tight, and in this way, moisture accumulation and condensation on the bearing layer 10 are prevented.

Materials on a mineral basis, such as clay, gypsum, etc., and on an organic basis, such as wood, are suitable, among others, as materials for the inner layer 11. For example, the layer 11 is configured as a wood, clay, or gypsum panel, or as a composite of such panels.

Typically, the inner layer 11 is designed for short-term storage, while the outer layer 9 acts for long-term storage. The time interval during which moisture can be absorbed in the outer layer 9 and released again is therefore longer than in the case of the inner layer 11. In this way, short-term moisture peaks in the interior can be absorbed by means of the inner layer 11, on the one hand, and the slower moisture changes on the exterior can be absorbed in effective manner, on the other hand, by means of the outer layer 9.

In the exemplary embodiments shown in FIGS. 1*a* and 1*b*, the outer wall furthermore has a layer in the form of an interior finish 12. This is configured in usual manner. Depending on the design of the interior space, the interior finish 12 can also be left out and/or replaced with a different layer, e.g. a wallpaper.

In the exemplary embodiments shown in FIGS. 1*a* and 1*b*, the two layers 9 and 11 act as moisture-buffering planes that are matched with the bearing layer 10 concretely used. In the finished construction, the water vapor is absorbed, on its path through the outer wall—whether from the outside or from the inside—ahead of the layer 10, in an amount that prevents a critical level of the water vapor from being reached ahead of the layer 10. The sorption-active composition of the outer wall allows releasing the absorbed water vapor again during other seasons, from the wall into the interior or the exterior. In this way, it can be avoided over multiple years that water accumulates in the outer wall. In the case of a suitable design, the performance capacity of the wall also does not decrease over the years.

In total, the outer wall acts by means of dampening and delaying temperature variations, by means of thermal mass and thermal inertia, as well as by means of storing moisture by means of materials capable of absorption. In this way, variations in the moisture and moisture peaks are reduced, so that moisture concentrations that would be harmful for the construction can be prevented.

The selection of the composition of the layers as well as the precise dimensioning of the individual layers, particularly the layer thickness, are performed, for example, by means of a suitable simulation program. This program allows calculating the behavior of the outer wall with regard to moisture and temperature ("hygrothermic behavior") on the basis of predetermined starting variables and the known physical equations. These physical equations relate, among other things, to heat and moisture transport, to the moisture absorption velocity, the moisture release velocity, and the sorption capacity.

Starting variables are, among others, local climate data (e.g. measured values regarding temperature and humidity, which were reached locally over the course of the year), data regarding the planned construction materials (e.g. heat conductivity, water vapor conductivity, etc., which the materials used demonstrate), and data that define the precise purpose of use and the desired concept of the building (e.g. type of desired façade such as exterior finish or suspended façade, planned use and design of the interior space, and the moisture load, size of the building, etc., that result from this).

The outer wall is then designed in such a manner, using the simulation calculations, that not too much moisture can collect on the inside of the wall, or that no relative humidity can occur that would lead to mold and condensation (also called "moisture avoidance condition" hereinafter). For example, it is demanded as a moisture avoidance condition that the moisture concentration in the bearing layer 10 does not reach the maximum of 100%, and that the moisture concentration in the layers 9 to 11, and preferably also in the layers 8 and 12, does not go above 80% over a specific period of time (e.g. two weeks and more). Of course, the latter condition can also be selected to be different, for example also in such a way that specific requirements with regard to permissible moisture are established for the individual layers.

In general, the possible starting variables have a broad spectrum. In particular, the local climate conditions and the user needs can vary greatly. Because of the layer-by-layer construction of the outer wall, a type of modular system is created, which allows adapting the outer wall to a broad spectrum of starting variables, in such a manner that the moisture avoidance condition is also met.

The outer wall is coordinated, with regard to water vapor transfer resistance, storage capacity, and insulating effect, in such a manner that condensation and mold are avoided. The outer wall has a range of effect defined by the SD-, FK-, and U-values, which lie in the following ranges, in terms of value:

The SD-value (water vapor diffusion resistance) amounts to at most 20 meters, preferably at most 15 meters, and particularly preferably at most 10 meters. Preferably, the SD-value amounts to at least 2 meters and/or at least 3 meters. The SD-values indicated relate, of course, to the resistance of the intact surface. Possible joins or other leaks are not taken into consideration.

The "FK-value 0/85" amounts to at least 1 $kg/m^2$, preferably at least 2 $kg/m^2$. Typically, the "FK-value 0/85" amounts to at most 20 $kg/m^2$ and/or at most 15 $kg/m^2$ and/or at most 12 $kg/m^2$.

The "FK-value 0/80" amounts to at least 2 $kg/m^2$, preferably at least 3 $kg/m^2$, and particularly preferably at least 4 $kg/m^2$.

The "FK-value 20/80" amounts to at least 2.0 $kg/m^2$, preferably at least 2.5 $kg/m^2$, and particularly preferably at least 3.0 $kg/m^2$.

The U-value (heat transfer coefficient) amounts to at most 1.5 $W/(m^2 \cdot K)$, preferably at most 1 $W/(m^2 \cdot K)$, and particularly preferably at most 0.7 $W/(m^2 \cdot K)$. Preferably, the U-value amounts to at least 0.1 $W/(m^2 \cdot K)$ and/or at least 0.15 $W/(m^2 \cdot K)$ and/or at least 0.19 $W/(m^2 \cdot K)$.

As is evident from FIG. 2, the SD- and U-values of the outer wall lie in the left lower range, which is indicated with 20. (The rectangle shown with a broken line in the range 20 indicates the preferred value range.) For a comparison, further ranges 21-24 are shown in FIG. 2, which indicate typical SD- and U-values for known buildings in Japan.

The outer layer 9 and/or the inner layer 11 comprise a moisture-buffering material that has a thermal mass that is typically greater than 100 $kJ/(m^3 \cdot K)$, preferably greater than 200 $kJ/(m^3 \cdot K)$, and particularly preferably greater than 300 $kJ/(m^3 \cdot K)$.

Each layer 8-12 can be structured in form of a homogeneous or heterogeneous layer. Furthermore, the individual layers 8-12 can be configured in a self-contained manner or they can also be configured such that adjacent layers engage with each other and/or overlap. When seen in the cross-section, the individual layer 8-12 can have a layer thickness which is substantially constant or variable.

To form a building sheath, additional building components such as floor and ceiling/roof have to be provided in addition to the outer walls. These building components can be structured in multiple layers in a similar way as the outer wall and be designed in such a manner that the building sheath, as a whole, has U-, SD- and FK-values such as those indicated above in connection with the outer wall.

The invention claimed is:

1. A wall configured to separate the inside of a building from the outside, wherein the wall has a water vapor diffusion resistance, SD-value, of at most 20 meters, a heat transfer coefficient, U-value, of the wall is at most 1.5 $W/(m^2 \cdot K)$, and the moisture storage capacity, FK-value, of the wall, determined from a comparison of the state of the wall at 80% relative humidity and a temperature of 20 degrees Celsius with the dry state of the wall is at least 2.0 $kg/m^2$, wherein the wall is configured for climatic conditions in which a water vapor stream moves from the inside to the outside and from the outside to the inside, the wall including at least one moisture-buffering layer having absorption properties to absorb water vapor as the water vapor stream moves from the inside to the outside of the wall and from the outside to the inside of the wall.

2. The wall according to claim 1, wherein the SD-value meets at least one of the following conditions:

the SD-value is at least 2 meters, and the SD-value is at least 3 meters.

3. The wall according to claim 1, wherein the SD-value meets at least one of the following conditions:

the SD-value is at most 15 meters, and the SD-value is at most 10 meters.

4. The wall according to claim 1, wherein the FK-value, determined from a comparison of the state of the wall at 80% relative humidity and a temperature of 20 degrees Celsius with the dry state of the wall, meets at least one of the following conditions:

the FK-value is at least 3.0 kg/m2, the FK-value is at least 4.0 kg/m2, the FK-value is at least 4.5 kg/m2, and the FK-value is at least 5.5 kg/m2.

5. The wall according to claim 1, wherein the FK-value, determined from a comparison of the state of the wall at 80% relative humidity and a temperature of 20 degrees Celsius with the state of the wall at 20% relative humidity and a temperature of 20 degrees Celsius, meets at least one of the following conditions:

the FK-value is at least 2.0 kg/m2, the FK-value is at least 2.5 kg/m2, and the FK-value is at least 3.0 kg/m2.

6. The wall according to claim 1, wherein the FK-value determined from a comparison of the state of the wall at 20% relative humidity and a temperature of 20 degrees Celsius with the dry state of the wall has a value FK1, and the FK-value determined from a comparison of the state of the wall at 80% relative humidity and a temperature of 20 degrees Celsius with the dry state of the wall has a value FK2, and the difference between the value FK2 and the value FK1 is at least 1.5 kg/m2.

7. The wall according to claim 1, wherein the U-value meets at least one of the following conditions:

the U-value is at least 0.1 W/(m2·K), the U-value is at least 0.15 W/(m2·K), the U-value is at least 0.19 W/(m2·K).

8. The wall according to claim 1, wherein the U-value meets at least one of the following conditions:

the U-value is at most 1 W/(m2·K), the U-value is at most 0.7 W/(m2·K), the U-value is at most 0.5 W/(m2·K).

9. The wall according to claim 1, further comprising at least one moisture-buffering layer.

10. The wall according to claim 9, wherein the moisture-buffering layer is substantially composed of organic materials, mineral materials, or a combination of organic and mineral materials.

11. The wall according to claim 10, wherein the materials comprise one or more of the following materials: wood, wood fiber, cellulose, clay, calcium silicate, activated charcoal, and gypsum.

12. The wall according to claim 1, further comprising a layer, the layer being, or including, one or more of the following:

heat-insulating and moisture-buffering, having an insulation that comprises multiple planes, having an insulation that comprises at least one water-vapor-inhibiting plane, and being disposed on the side of a bearing layer that faces the exterior.

13. The wall according to claim 1, further comprising a bearing layer being, or including, one or more of the following:

substantially structured from wood, structured from wood boards connected with one another crosswise, and disposed between two moisture-buffering layers.

14. The wall according to claim 1, further comprising an exterior finish that is biocide-free, or having a back-ventilated façade.

15. A wall configured to separate the inside of a building from the outside, the wall being configured for climatic conditions in which a water vapor stream moves from the inside to the outside and the outside to the inside, the wall comprising:

a bearing layer;

an outer layer; and an inner layer, wherein the outer layer and the inner layer comprise materials that are moisture-buffering thereby causing the outer layer and the inner layer to absorb water vapor as the water vapor stream moves from the inside to the outside of the wall and from the outside to the inside of the wall, the outer layer and the inner layer absorb lesser normal and transverse forces than the bearing layer when the wall is under load, and the moisture-buffering materials have a thermal mass greater than 100 kJ/($m^3$*K).

16. The wall according to claim 15, wherein the thermal mass that meets at least one of the following conditions:

the thermal mass is greater than 200 kJ/(m3·K), and the thermal mass is greater than 300 kJ/(m3·K).

17. The wall according to claim 15, wherein the outer layer has greater heat insulation than the inner layer.

18. The wall according to claim 15, wherein the inner layer has a greater thermal mass than the outer layer.

19. The wall according to claim 15, wherein the bearing layer inhibits water vapor.

20. The wall according to claim 15, wherein the wall has a water vapor diffusion resistance, SD-value, of at most 20 meters, the heat transfer coefficient, U-value, of the wall is at most 1.5 W/(m2·K), and the moisture storage capacity, FK-value, of the wall, determined from a comparison of the state of the wall at 80% relative humidity and a temperature of 20 degrees Celsius with the dry state of the wall is at least 2.0 kg/m2.

21. A building sheath having at least one wall according to claim 1.

22. The building sheath according to claim 21, wherein the wall is a bearing wall.

23. A wall configured to separate the inside of a building from the outside, the wall comprising:

a bearing layer;

an outer layer; and an inner layer, wherein the wall is configured for climatic conditions in which a water vapor stream moves from the inside to the outside and the outside to the inside, the outer layer and the inner layer comprising materials that are moisture-buffering causing the outer layer and the inner layer to absorb water vapor as the water vapor stream moves from the inside to the outside of the wall and from the outside to the inside of the wall, the outer layer and the inner layer absorb lesser normal and transverse forces than the bearing layer when the wall is under load, and the moisture-buffering materials have a thermal mass greater than 100 kJ/($m^3$*K).

* * * * *